US005497048A

United States Patent [19]

Burd

[11] Patent Number: 5,497,048

[45] Date of Patent: Mar. 5, 1996

[54] MULTIPLE TRIANGULARLY SHAPED CONCENTRIC ANNULAR FLUORESCENT TUBES FOR REFLECTIVE LAMPS

[76] Inventor: David M. Burd, P.O. Box 123, Bentonville, Va. 22610

[21] Appl. No.: 302,469

[22] Filed: Sep. 12, 1994

[51] Int. Cl.[6] ..... H01J 5/10

[52] U.S. Cl. ..... 313/573; 313/113

[58] Field of Search ..... 313/573, 493, 313/317, 634, 113; 362/216

[56] References Cited

U.S. PATENT DOCUMENTS

| | | | |
|---|---|---|---|
| 1,961,735 | 6/1934 | Braun | 40/545 |
| 2,102,049 | 12/1937 | Warren | 445/24 |
| 2,878,372 | 3/1959 | Fry | 362/216 |
| 3,047,763 | 7/1962 | Inman | 313/493 |
| 3,184,585 | 5/1965 | Rouy | 362/97 |
| 4,280,167 | 7/1981 | Ellet | 362/33 |
| 4,488,208 | 12/1984 | Miller | 362/339 |
| 4,558,400 | 12/1985 | Buser | 362/222 |
| 5,034,655 | 7/1991 | Murayama et al. | 313/493 |
| 5,174,646 | 12/1992 | Sminovitch et al. | 362/218 |
| 5,233,262 | 8/1993 | Lynn et al. | 313/113 |
| 5,285,361 | 2/1994 | McKillip | 362/125 |

FOREIGN PATENT DOCUMENTS

| | | | |
|---|---|---|---|
| 63-81753 | 4/1988 | Japan | H01J 61/33 |
| 5325894 | 12/1993 | Japan | H01J 61/30 |
| 1012333 | 12/1965 | United Kingdom | H01J 61/02 |

*Primary Examiner*—Donald J. Yusko
*Assistant Examiner*—Lawrence O. Richardson
*Attorney, Agent, or Firm*—Larson and Taylor

[57] ABSTRACT

Multiple concentric, triangular cross-sectioned fluorescent lamp tubes, located substantially in the same plane with respect to each other, are utilized in appropriate assemblies for: 1) a direct screw-in replacement for reflective incandescent lamps and; 2) recessed ceiling fixtures that are typically hardwired. The inherent triangular geometries of the concentric, substantially same plane lamps create mutually benefiting reflecting surfaces to maximize the net light output. The triangular geometry enables light from two sides of the fluorescent tubing to be efficiently cast if desired (or muted by absorbent housing wall if desired). The remaining side, or base, of each triangular tube produces light that is redirected by opposing, intersecting, coaxial, conical reflectors arranged to direct the light through the unobstructed center of the concentric tubing arrangement. A transparent collimating structure adjacent to the triangular tub bases is used to enhance control of the light emanating from the base. The arrangement is incorporated in a single assembly with an Edison screw-in base and as lamp assemblies for use in hardwired fixtures.

9 Claims, 2 Drawing Sheets

MULTIPLE TRIANGULARLY SHAPED CONCENTRIC ANNULAR FLUORESCENT TUBES FOR REFLECTIVE LAMPS

BACKGROUND OF THE INVENTION

1. Field of the Invention

The present invention relates to fluorescent lighting systems and devices.

2. The Prior Art

Fluorescent lighting in compact versions, such as Philips' U.S. Pat. No. 4,199,708 and the well known CIRCLINE have been replacing incandescents in their myriad applications for many years. However, fluorescent replacements for reflective incandescents such as R30, R40 and PAR38 lamps have been notable for their inadequate lumen output. The many compact versions of reflective lamps have used U-shaped lamps, twin lamps, quad lamps and other assorted geometries. These reflective compacts have also demonstrated significant dimensional incompatibilities caused by awkwardly long straight lengths of fluorescent tubes.

Typically, today's compact fluorescent reflective assembly has its tubing axes in line with its screw-in base thereby presenting the smallest tubing surface area to the illuminated object. This orientation lowers net lumen output as light emanated from most of the tubing has to reflect a multiplicity of times to emanate from the overall lamp assembly, losing lumen output with each reflection. Quad tubing arrangements and triple twin arrangements also limit their lumen output as much of their original light is directed inward toward the other tubes, thus significantly reducing the total light emanating from the overall assembly. Hardwired ceiling fixtures using quads and twins also have significant lumen loss even though they are mounted horizontally with respect to the typical illuminated surface or object. These losses stem from the fact that they block their own light when mounted in close proximity to the top of the fixture. As in the screw-in floodlamp version using quads, hardwired ceiling fixtures employing quads also have significant light lost internally to their own lamping structure.

U.S. Pat. No. 4,833,574 by Gallagher uses multiple annular tubes to generate large amounts of light, but, significantly, this patent's use of square tubing arrangements in different planes also demonstrates large inefficiencies. For example, Gallagher's use of two square tubes directly on top of each other creates a tubing configuration which results in the immediate loss of three-eights of the fluorescing light generated because three of the eight sides have no exposure to the illuminated object.

The many manifestations of reflective compact fluorescent lamps, including U.S. Pat. No. 5,130,910 and 4,723,200, have large inherent lumen losses, particularly when quad type tubes are the light source. For example, the Phillips compact reflective SL18/R40 EARTH LIGHT using U-shaped tubing, claims an 800 lumen output. It is expected that the embodiment of this invention will exceed 1600 lumens, thus approaching the typical 1730 lumen output of 150 watt PAR 38 incandescents. The situation as described makes it apparent that the lumen output of today's fluorescent reflective lamps and ceiling fixtures, such as described in U.S. Pat. No. 4,947,297, can be greatly improved. Great improvement can also be made by creating fluorescent reflective lamps similar to incandescent reflector shapes while generating comparable light output.

SUMMARY OF THE INVENTION

The object of this invention is to create reflective compact fluorescent lamps with lumen outputs substantially greater than existing embodiments of comparable size. This is achieved by creating concentric and complementary triangularly shaped lamps, mounted substantially in the same plane, with appropriate intersecting, coaxial, conical reflectors and collimating devices. Combined with appropriate housing, ballast and other necessary structure including an Edison base, the embodiment will produce usable light output comparable to incandescent reflective lamps requiring much greater wattage. This invention in the form of multiple triangular lamp tubing, appropriately mounted, also enables hardwired ceiling fixtures to be significantly improved in lumen output. It is important to note that this invention allows fluorescent lamps to be manufactured to closely match incandescent reflective lamp shapes, while approaching comparable light output.

DESCRIPTION OF THE PREFERRED EMBODIMENTS

Figure 1:
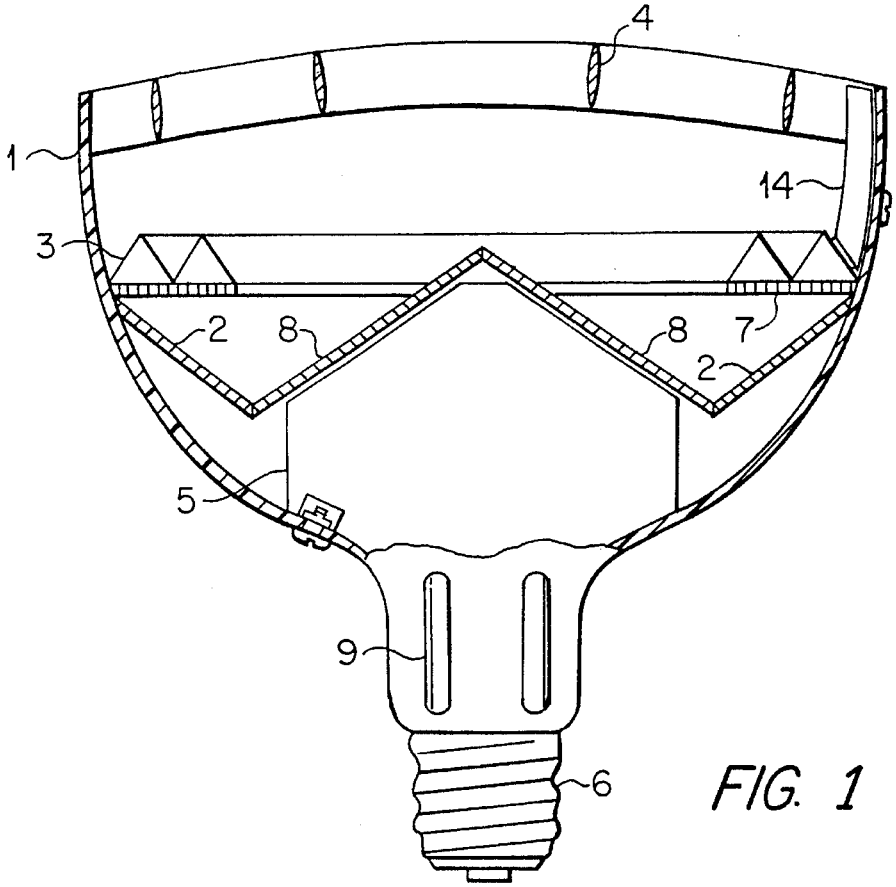
FIG. 1 is a transverse cross section view of the invention in a preferred screw-in embodiment.
Figure 4:
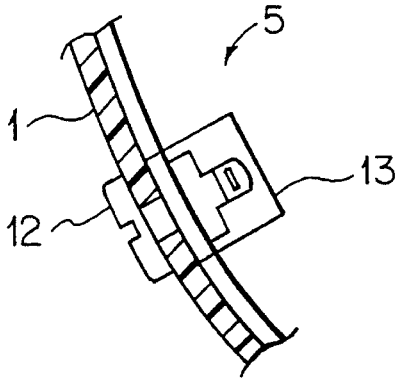
FIG. 4 is a detail of the encircled area located generally at the bottom left of FIG. 1, which shows one technique for fastening the ballast to the housing.

FIG. 1 shows a section version of the invention in the general shape of a PAR38 lamp. The overall housing 1 contains the electrical power supply 5 necessary for the operation of the low pressure mercury vapor lamping, commonly known as fluorescent lamping when appropriate phosphors coat the inner surfaces of the tubing. The housing 1, though shown as a PAR38 outline, would likely have straighter geometry to facilitate injection molded plastic technology. Though FIG. 1 is a section view, the Edison base and cooling slots 9 are not sectioned for the purpose of clarity. FIG. 4 shows housing 1 to be plastic material with screw 12 fastening ballast 5 to housing 1. Component 13 is a simple threaded bracket mounted to ballast 5. As shown in FIG. 4, the part of 5 illustrated may be a printed circuit board of 5. The triangular tubing 3 has substantially flat surfaces within reasonable manufacturing tolerances and the corners of the triangular shapes may be rounded or truncated for ease of manufacturing and optimum phosphor performance.

Figure 2:
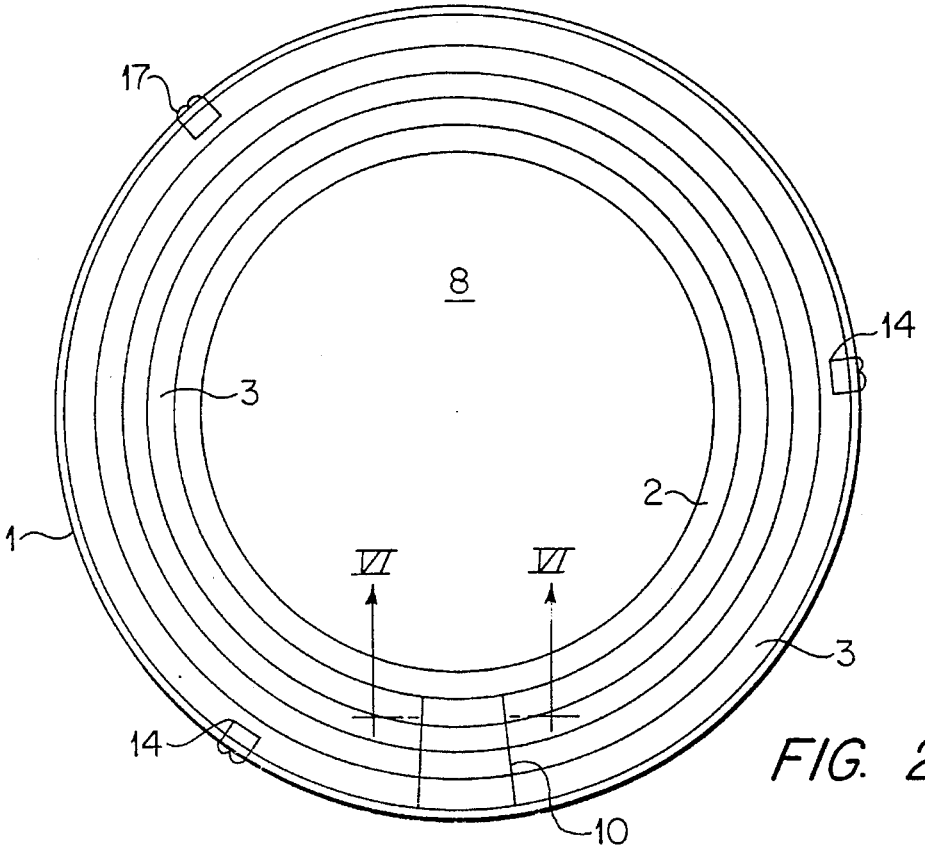
FIG. 2 is a top plan view of the embodiment of FIG. 1.

It is to be noted that the triangular tubing shapes 3 are open to variation with regard to their enclosed angles. It is the multiple triangle principle that is important, as this configuration enables light emanated from four sides of the pair of triangles 3 to be cast and reflected effectively toward the illuminated object. To explain, the slant sides of the triangles 3 act as reflectors and thus any light impinging the slant side of one triangle from, e.g., an adjacent slant side of an adjacent triangle will be reflected toward the illuminated object. Moreover, any side receiving light impinging thereon will reflect such light. The remaining side of the triangles, or bases, emanates light that is redirected by intersecting, coaxial, reflectors 2 and 8 outward through the center of the assembly toward the illuminated object. As is evident from FIGS. 1 and 2 taken together, reflector 2 is generally frusto-conical while reflector 8 is conical.

To enhance utilization of the light emanating from the base, a transparent collimating ring 7 may be employed as shown. One example, though not limiting, would be two equilateral triangular lamp tubes 3 having two-thirds of their total surfaces exposed outward. The remaining one-third of base generated light is redirected through 7, as noted previously, outward through the open center of the concentric annular lamp tubes. It is understood that reflectors 2 and 8, though specified as two separate structures in FIG. 1, may be made as a single molded or stamped piecepart. The reflective surfaces geometrically function as intersecting, opposing, coaxial cones to optimally redirect tubing base light out of housing 1. Tabs 11 project from 2 through appropriately located holes in 1 to illustrate an economical, though not limiting, assembly technique. Reflector 2, mounted with tabs 11 through slots in housing 1, creates support for ring 7 and tubes 3. Transparent collimating rings suitable for use as collimating ring 7 are conventional.

Figure 5:
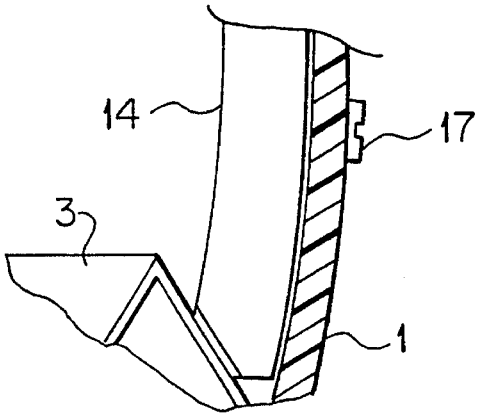
FIG. 5 is a detail of the encircled area located generally at the top right of FIG. 1, which shows a retainer for securing the lamps.

FIG. 5 shows lamp retainer 14 secured through slot in housing 1 by screw 17. Lamp retainers 14 would typically be three in number located equally apart to form a plane. Two of retainers 14 may be of economical self-tapping plastic while the third retainer 14 may be copper, allowing said 14 to function as a thermal bridge to ambient air temperature. It is well Known in the art of fluorescent lamps that maintenance of a relative cool spot on the surface of said lamp is effective in maintaining high lumen output of the entire lamp. Thermally conductive retainer 14 is one, though not limiting, means of achieving said cool spot.

A single pair of triangular tubes 3 are shown, though it is understood that in some variations another pair may be added concentrically with all lamping appropriately sized so the middle of the concentric assembly remains open to allow light to be reflected off reflectors 2 and 8 toward the object illuminated.

The Edison base 6 shown in FIG. 1 combined with the approximate PAR38 incandescent outline shape is intentional. Many of the manufactured compact reflector lamps available today are unusable for direct replacement of incandescent reflector lamps because of dimensional incompatibilities. This invention makes possible a higher lumen output lamp assembly that is comparable to incandescents not only in usable light but also in shape. Using annular lamps 3 as is shown, it is apparent that there is generous space for an incorporated power supply 5, or ballast as it is commonly known, while still maintaining the PAR38 shape. For reference, the mean overall length of a PAR38 lamp is 5.31 inches. Grating 4 is shown in FIG. 1 as a structure that may be employed for several reasons; 1) to prevent the emanating of light from being broadcast too widely, and 2) to provide protection for the fluorescent tubing. Conventional gratings can be used for this purpose.

Figure 3:
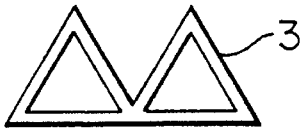
FIG. 3 shows a section view of a pair of tubes cast as a single piece of material.
Figure 6:
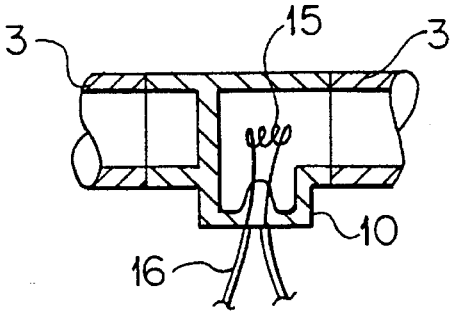
FIG. 6 is a cross sectional view taken generally along line V—V of FIG. 2, which shows end closures with electrodes.

FIG. 3 shows a section view detail of the triangular tubing 3. Consideration of manufacturing processes may create annular concentric tubes singly or as a cast pair. End closures 10 of the concentric annular triangular tubes will include appropriate electrodes to allow the enclosed low pressure medium to sustain continuous fluorescent light generation by phosphors coating the inside surfaces of the tubing. An illustrative tubing end closure 10 containing electrodes 15 is shown in FIG. 6 with connecting wires 16 leading to ballast 5. The circuitry necessary to connect base 6 through ballast 5 to the lamp assembly 3 is conventional. Further, the pair of tubes 3 can be cast or drawn as a single vitreous unit with shared material connecting the separately enclosed spaces. Such casting and drawing is conventional.

I claim:

1. A fluorescent lamp device comprising a housing including a light outlet opening, at least two annular fluorescent lamp tubes disposed in concentric relation within said housing adjacent to each other in substantially the same plane so as to define an open central space centrally of said lamp tubes within said housing, said lamp tubes each being in the shape of a triangle in cross section including two sides meeting a common apex and a base, said apex being directed toward said outlet opening and said device further comprising reflector means, disposed within said housing on the side of said tubes away from said outlet opening, for directing light emitted in a direction away from said light opening from the region of said base such that the emitted light follows a path through said central space and out through said outlet opening.

2. A device as claimed in claim 1 wherein the bases of said tubes are contiguous.

3. A device as claimed in claim 1 wherein adjacent corners of said tubes are joined together so that the tubes form an integral structure.

4. A device as claimed in claim 1 wherein said reflector means is W-shaped in cross section and includes outer frusto-conical reflector surface disposed to receive light emitted from the region of the base of said tubes and an inner conical reflector surface disposed to receive light from said outer reflector surface and to direct light received from said outer reflector surface through said central space.

5. A device as claimed in claim 4 wherein said inner conical reflector surface includes an apex located at a level with the sides of the tubes.

6. A device as claimed in claim 1 further comprising a transparent collimating ring for collimating the light from the region of the bases of said tubes.

7. A device as claimed in claim 1 wherein said housing further contains a ballast connected to said lamps.

8. A device as claimed in claim 1 wherein said housing includes a base portion forming a screw-in connector.

9. A device as claimed in claim 1 further comprising a grating disposed in the outlet opening of said housing.

* * * * *